US009134662B2

(12) United States Patent
Park et al.

(10) Patent No.: US 9,134,662 B2
(45) Date of Patent: Sep. 15, 2015

(54) IMAGE FORMING APPARATUS AND CONTROL METHOD FOR CONFIRMING A PAPER ROLLING STATE OF A FUSING DEVICE

(71) Applicant: SAMSUNG ELECTRONICS CO., LTD., Suwon-si, Gyeonggi-do (KR)

(72) Inventors: Kwang Sung Park, Seoul (KR); Soo Yong Jung, Suwon-si (KR); Yun Su Kim, Yongin-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/511,882

(22) Filed: Oct. 10, 2014

(65) Prior Publication Data

US 2015/0063853 A1 Mar. 5, 2015

Related U.S. Application Data

(63) Continuation of application No. 13/432,346, filed on Mar. 28, 2012, now Pat. No. 8,861,995.

(30) Foreign Application Priority Data

Jun. 29, 2011 (KR) ..... 10-2011-0063547

(51) Int. Cl.
*G03G 15/20* (2006.01)
*G03G 15/00* (2006.01)

(52) U.S. Cl.
CPC ..... *G03G 15/2039* (2013.01); *G03G 15/2028* (2013.01); *G03G 15/657* (2013.01); *G03G 15/70* (2013.01)

(58) Field of Classification Search
CPC ..... G03G 15/2039; G03G 15/205; G03G 15/2046; G03G 2215/00548
USPC ..... 399/21, 33, 69
See application file for complete search history.

(56) References Cited

U.S. PATENT DOCUMENTS 7,773,893 B2 8/2010 Wagatsuma
8,861,995 B2 * 10/2014 Park et al. ..... 399/33

FOREIGN PATENT DOCUMENTS

JP 2003-122198 4/2003
JP 2007-156348 6/2007

OTHER PUBLICATIONS

Office Action mailed Mar. 24, 2014 in co-pending U.S. Appl. No. 13/432,346.
Notice of Allowance mailed Jun. 10, 2014 in co-pending U.S. Appl. No. 13/432,346.
U.S. Appl. No. 13/432,346, filed Mar. 28, 2012, Kwang Sung Park, Samsung Electronics Co., Ltd.

* cited by examiner

*Primary Examiner* — William J Royer
(74) *Attorney, Agent, or Firm* — Staas & Halsey LLP

(57) ABSTRACT

An image forming apparatus and a control method thereof in which occurrence or removal of a paper rolling state in a fusing device is judged based on temperature of the fusing device. The apparatus includes a temperature sensor to sense temperature of the fusing device, a memory to store information about occurrence or removal of the paper rolling state, and a controller to judge occurrence or removal of the paper rolling state. The controller detects an initial temperature of the fusing device when the apparatus is turned off and then on in a state in which the information about occurrence of the paper rolling state is stored in the memory, heats the fusing device by applying power thereto for a predetermined time based on the initial temperature, and judges occurrence or removal of the paper rolling state based on temperature of the fusing device detected after power application.

19 Claims, 10 Drawing Sheets

FIG. 8

| TRANSFER RESISTANCE VALUE | TRANSFER ENVIRONMENT |
|---|---|
| FIRST RESISTANCE VALUE | HIGH-TEMPERATURE AND HIGH-HUMIDITY |
| SECOND RESISTANCE VALUE | |
| ⋮ | |
| A RESISTANCE VALUE | NOMRAL-TEMPERATURE AND NORMAL-HUMIDITY |
| A+1 RESISTANCE VALUE | |
| ⋮ | |
| B RESISTANCE VALUE | |
| B+1 RESISTANCE VALUE | |
| ⋮ | |
| C RESISTANCE VALUE | |
| C+1 RESISTANCE VALUE | |
| ⋮ | |
| D RESISTANCE VALUE | |
| D+1 RESISTANCE VALUE | LOW-TEMPERATURE AND LOW-HUMIDITY |
| ⋮ | |
| E RESISTANCE VALUE | |

IMAGE FORMING APPARATUS AND CONTROL METHOD FOR CONFIRMING A PAPER ROLLING STATE OF A FUSING DEVICE

CROSS-REFERENCE TO RELATED APPLICATIONS

This application is a Continuation Application of application Ser. No. 13/432,346, filed Mar. 28, 2012 and claims the benefit of Korean Patent Application No. 10-2011-0063547, filed on Jun. 29, 2011 in the Korean Intellectual Property Office, the disclosure of which is incorporated herein by reference.

BACKGROUND

1. Field

Embodiments of the present invention relate to an image forming apparatus and a control method thereof, which enable confirmation as to whether or not a fusing device has been released from a paper rolling state.

2. Description of the Related Art

An image forming apparatus is designed to form an image on a recording medium. Examples of image forming apparatuses include printers, copiers, fax machines, and devices combining functions thereof.

In an electrophotographic image forming apparatus, after light is irradiated to a photoconductor, a surface of which has been charged, so as to form an electrostatic latent image on the surface of the photoconductor, developer is fed to the electrostatic latent image such that the electrostatic latent image is developed into a visible image. Then, the visible developer image is transferred from the photoconductor to a recording medium S directly or indirectly by way of an intermediate transfer medium. The visible image transferred to the recording medium is fixed to the recording medium by operation of a fusing device.

A fusing device includes a heating member to apply heat to the recording medium. The heating member may be heated in an inductive heating manner, and a temperature sensor for temperature control may be attached to the heating member.

Rolling of the recording medium (hereinafter, referred to as 'paper rolling') may occur in the fusing device due to paper defects, and the like. Once such paper rolling has occurred, the image forming apparatus stops operation and an error message is displayed on a display.

SUMMARY

It is one aspect of the present invention to provide an image forming apparatus and a control method thereof, in which whether or not paper rolling has occurred may be judged using only information about temperature variation of a fusing device.

It is another aspect of the present invention to provide an image forming apparatus and a control method thereof, in which whether or not a paper rolling state has been removed is automatically ascertainable when power is turned off and then on after paper rolling occurs.

Additional aspects of the invention will be set forth in part in the description which follows and, in part, will be obvious from the description, or may be learned by practice of the invention.

In accordance with one aspect of the invention, an image forming apparatus includes a fusing device, a temperature sensor to sense a temperature of the fusing device, a memory in which information about occurrence and removal of a paper rolling state in the fusing device is stored, and a controller, which detects an initial temperature of the fusing device when the image forming apparatus is turned on in a state in which information about occurrence of the paper rolling state is stored in the memory, which heats the fusing device by applying power to the fusing device for a predetermined time if the initial temperature of the fusing device is less than a reference temperature or if the initial temperature exceeds the reference temperature, but is within a tolerance range, and which judges whether or not the paper rolling state has been removed based on a temperature of the fusing device detected after power is applied to the fusing device.

The memory may be a non-volatile memory and may maintain the information about occurrence of the paper rolling state stored therein even if the image forming apparatus is turned off.

The judging whether or not the paper rolling state has been removed based on the temperature of the fusing device may include judging that the paper rolling state has been removed if the temperature of the fusing device detected after power is applied to the fusing device for the predetermined time exceeds a predetermined reference temperature.

The judging whether or not the paper rolling state has been removed based on the temperature of the fusing device may include detecting the temperature of the fusing device multiple times while power is applied to the fusing device for the predetermined time, and judging whether or not the paper rolling state has been removed by comparing the multiple detected temperatures of the fusing device with different reference temperatures ordered by time.

The judging whether or not the paper rolling state has been removed by comparing the multiple detected temperatures of the fusing device with different reference temperatures may include comparing the detected temperatures of the fusing device with the respective corresponding reference temperatures ordered by detection time, and judging that the paper rolling state has been removed if all the detected temperatures of the fusing device exceed the respective corresponding reference temperatures.

The judging whether or not the paper rolling state has been removed by comparing the multiple detected temperatures of the fusing device with different reference temperatures may include comparing an average gradient of the multiple detected temperatures of the fusing device with an average gradient of the different reference temperatures, and judging that the paper rolling state has been removed if the average gradient of the temperatures of the fusing device exceeds the average gradient of the different reference temperatures.

The judging whether or not the paper rolling state has been removed based on the temperature of the fusing device may include judging that the paper rolling state has not been removed if the temperature of the fusing device detected after power is applied to the fusing device for the predetermined time is less than the predetermined reference temperature.

The image forming apparatus may further include a transfer resistance detector to detect a transfer resistance between a transfer roller and a photoconductor included in the image forming apparatus, and the memory may store information about a transfer environment corresponding to the transfer resistance.

The memory may store a look-up table which represents a power application time with respect to the fusing device to judge whether or not the paper rolling state has been removed, wherein the power application time corresponds to at least one of the transfer environment information based on the transfer resistance and the initial temperature of the fusing device.

In accordance with another aspect of the invention, a control method of an image forming apparatus, includes storing information about occurrence of a paper rolling state of a fusing device, detecting an initial temperature of the fusing device if the image forming apparatus is turned on in a state in which the information about occurrence of the paper rolling state is stored in a memory, heating the fusing device by applying power to the fusing device for a predetermined time if the initial temperature is less than a reference temperature, and judging whether or not the paper rolling state has been removed based on the temperature of the fusing device detected after the power is applied.

In the heating the fusing device by applying power to the fusing device for the predetermined time, the predetermined time may be determined based on at least one of the initial temperature of the fusing device and a transfer environment of the image forming apparatus.

The judging whether or not the paper rolling state has been removed may include judging that the paper rolling state has been removed if the temperature of the fusing device detected after power is applied for the predetermined time exceeds a preset reference temperature.

The judging whether or not the paper rolling state has been removed may include judging that the paper rolling state has not been removed if the temperature of the fusing device detected after power is applied for the predetermined time is less than a preset reference temperature.

The judging whether or not the paper rolling state has been removed may include detecting the temperature of the fusing device multiple times, comparing the multiple detected temperatures of the fusing device with different reference temperatures, and judging that the paper rolling state has been removed if all the multiple detected temperatures of the fusing device exceed the respective reference temperatures.

The judging whether or not the paper rolling state has been removed may include detecting the temperature of the fusing device multiple times, comparing the multiple detected temperatures of the fusing device with different reference temperatures, and judging that the paper rolling state has not been removed if at least one of the multiple detected temperatures of the fusing device is less than the corresponding reference temperature.

The judging whether or not the paper rolling state has been removed may include detecting the temperature of the fusing device multiple times to calculate an average gradient of the temperatures, and judging that the paper rolling state has been removed if the average gradient exceeds a predetermined reference gradient.

The judging whether or not the paper rolling state has been removed may include detecting the temperature of the fusing device multiple times to calculate an average gradient of the temperatures, and judging that the paper rolling state has not been removed if the average gradient is less than a predetermined reference gradient.

BRIEF DESCRIPTION OF THE DRAWINGS

These and/or other aspects of the invention will become apparent and more readily appreciated from the following description of the embodiments, taken in conjunction with the accompanying drawings of which:

FIG. 8 is a table illustrating transfer environments depending on the magnitude of transfer resistance;

DETAILED DESCRIPTION

Figure 1:
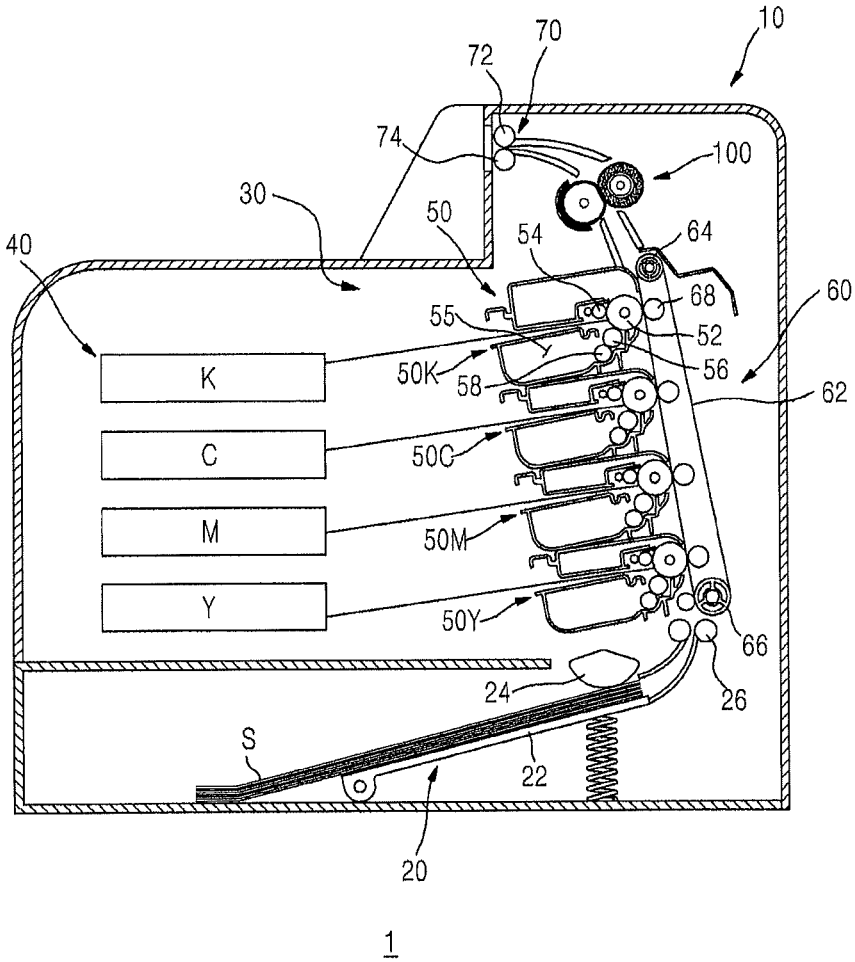
FIG. 1 is a schematic sectional view of an electrophotographic image forming apparatus in accordance with an embodiment of the present invention.

Reference will now be made in detail to the embodiments of the present invention, examples of which are illustrated in the accompanying drawings, wherein like reference numerals refer to like elements throughout.

FIG. 1 is a schematic sectional view of an electrophotographic image forming apparatus 1 in accordance with an embodiment of the present invention.

As illustrated in FIG. 1, the image forming apparatus 1 includes a main body 10, a recording media feed device 20, a printing system 30, a fusing device 100 and a recording media discharge device 70.

The main body 10 defines an external appearance of the image forming apparatus 1 and is configured to support a variety of elements installed therein. The main body 10 includes a cover (not shown) to open or close a part of the main body 10, and a main body frame (not shown) to support or secure the variety of elements installed in the main body 10.

The recording media feed device 20 serves to feed recording medium S to the printing system 30. The recording media feed device 20 includes a tray 22 on which the recording media S is stacked, and a pickup roller 24 to pick up the recording media S stacked on the tray 22 sheet by sheet. Each recording medium S, picked up by the pickup roller 24, is conveyed to the printing system 30 by a conveyance roller 26.

The printing system 30 may include a light scanning device 40, a developing device 50 and a transfer device 60.

The light scanning device 40 includes a scanning optical system (not shown) and serves to irradiate light corresponding to image information of yellow, magenta, cyan and black images according to print signals.

The developing device 50 serves to form a visible image on a photoconductor 52 according to image information input from an external appliance, such as a computer, and the like. The image forming apparatus 1 in accordance with the present embodiment is a color image forming apparatus and the developing device 50 usable with the color image forming apparatus 1 includes four developing units 50Y, 50M, 50C and 50K in which different colors of toners, such as yellow, magenta, cyan and black toners, are respectively accommodated.

Each of the developing units 50Y, 50M, 50C and 50K includes the photoconductor 52, a charge roller 54, a developer storage chamber 55, a developing roller 56 and a feed roller 58. The charge roller 54 charges a surface of the photoconductor 52 with a predetermined electric potential. If the light scanning device 40 irradiates light to the surface of the charged photoconductor 52, an electrostatic latent image is formed on the photoconductor 52. The feed roller 58 feeds developer stored in the developer storage chamber 55 to the developing roller 56, and the developing roller 56 feeds the developer to the electrostatic latent image formed on the photoconductor 52, whereby formation of a visible image is possible.

The transfer device 60 serves to transfer the visible image formed on the photoconductor 52 to the recording medium S. The transfer device 60 may include a transfer belt 62, which performs circulation in contact with each photoconductor 52, a transfer belt driving roller 64 to drive the transfer belt 62, a tension roller 66 to maintain tension of the transfer belt 62, and four transfer rollers 68 to transfer the visible image formed on each photoconductor 52 to the recording medium S.

The recording medium S is conveyed at the same speed as the traveling speed of the transfer belt 62 while being adhered to the transfer belt 62. In this case, voltage having polarity opposite to that of the developer adhered to each photoconductor 52 is applied to each transfer roller 68, causing a developer image on the photoconductor 52 to be transferred to the recording medium S.

The fusing device 100 serves to fix the developer image, which has been transferred to the recording medium S by the transfer device 60, to the recording medium S.

The recording media discharge device 70 serves to discharge the recording medium S out of the main body 10. The recording media discharge device 70 includes a discharge roller 72 and a pinch roller 74 arranged to face the discharge roller 72.

Figure 2:
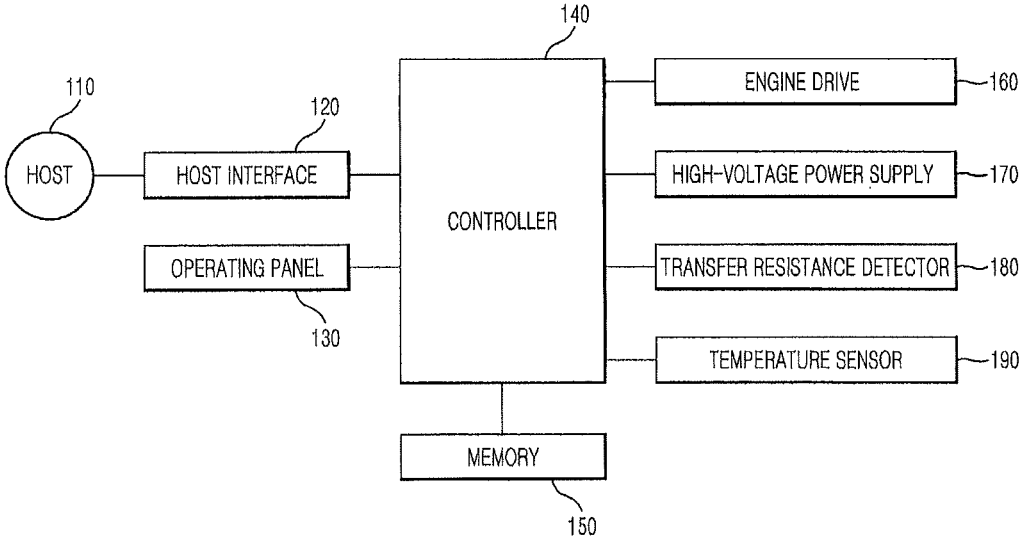
FIG. 2 is a control block diagram of the image forming apparatus in accordance with the embodiment of the present invention.

FIG. 2 is a control block diagram of the image forming apparatus 1 in accordance with the embodiment of the present invention.

The image forming apparatus 1 includes a controller 140 to control general operations of the image forming apparatus 1, a host interface 120 to enable communication between the controller 140 and a host 110, such as, e.g., a personal computer, an operating panel 130 having a key input unit to allow a user to input various commands and a display to provide the user with visual operational information, a memory 150 in which programs and various information of the image forming apparatus 1 are stored, an engine drive 160 to drive an image forming apparatus engine, a high-voltage power supply 170 to apply high voltage to the charge roller 54, developing roller 56 and transfer roller 68 of the image forming apparatus 1, a transfer resistance detector 180 to indicate a resistance value of the transfer roller 68 and a temperature sensor 190 to sense a temperature of a fusing roller 91 of the fusing device 100.

Figure 3:
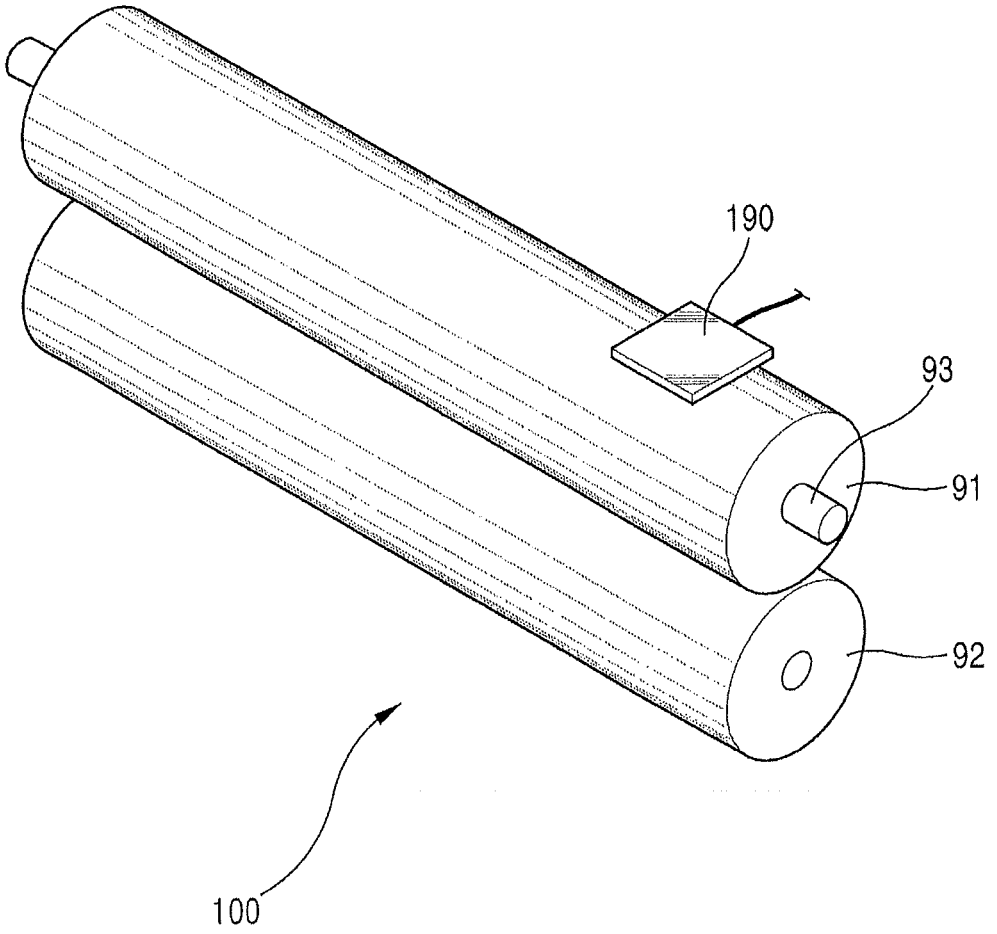
FIG. 3 is a perspective view illustrating a fusing device usable with the image forming apparatus in accordance with the embodiment of the present invention.
Figure 4:
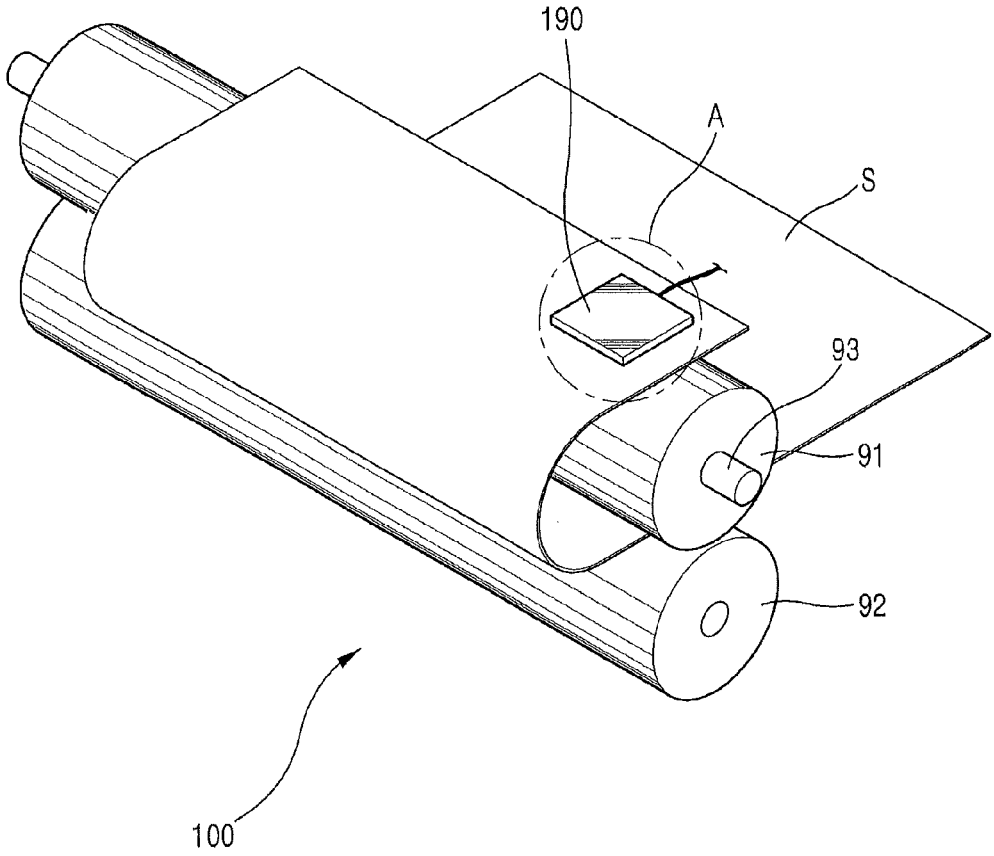
FIG. 4 is a perspective view illustrating a state in which paper is rolled in the fusing device of the image forming apparatus in accordance with the embodiment of the present invention.

The controller 140 functions to detect paper rolling caused when the recording medium S is rolled in the fusing device 100. The controller 140 may detect the paper rolling using temperature variation of the fusing roller 91. Referring to FIG. 3, the fusing device 100 includes the fusing roller 91 and a pressure roller 92 coming into contact with the fusing roller 91 so as to apply constant pressure to the fusing roller 91. The fusing roller 91 contains a heating lamp 93 to heat the fusing roller 91. The temperature sensor 190 is installed to the fusing roller 91 so as to sense a temperature of the fusing roller 91. Referring to FIG. 4, if the recording medium S is accidentally rolled on the fusing roller 91 while passing between the fusing roller 91 and the pressure roller 92, the recording medium S is jammed between the fusing roller 91 and the temperature sensor 190, acting to prevent transfer of heat from the fusing roller 91 to the temperature sensor 190, as illustrated by FIG. 4 reference letter A, which causes rapid drop of temperature sensed by the temperature sensor 190. If the rapid temperature drop of the fusing roller 91 occurs, the controller 140 may judge that paper rolling has occurred in the fusing device 100. Here, the rapid drop of temperature means that the drop rate of temperature sensed by the temperature sensor 190 exceeds a reference temperature variation per unit time that is preset in the memory 150.

Once that paper rolling has occurred on the fusing roller 91 is judged, the controller 140 stops the engine drive 160 and intercepts power applied by the high-voltage power supply 170 so as to prevent overheating of the fusing device 100.

Also, once that paper rolling has occurred on the fusing roller 91 is judged, the controller 140 loads an error message on the display (not shown) provided at the operating panel 130 and stores an error state due to paper rolling in the memory 150. The memory 150 is a non-volatile memory that does not lose information stored therein even if power is turned off.

If the user performs a predefined key input operation using the operating panel 130 or inputs an error release command using the host 110 after removing the rolled paper from the fusing device 100, the controller 140 cancels the error state.

The controller 140 may confirm whether or not the fusing device 100 has been released from the paper rolling state when the user turns the image forming apparatus 1 off and then on in a state in which information stored in the memory 150 says that the fusing device 100 remains in the paper rolling state. That is, when the user turns the image forming apparatus 1 off and then on in a state in which information about occurrence of the paper rolling is stored in the memory 150, a temperature measured by the temperature sensor 190 installed to the fusing device 100 may be transmitted to the controller 140. If the temperature exceeds a reference temperature (e.g., 40° C.), this means an error state. If the temperature is less than the reference temperature, the controller 140 may confirm whether or not the paper rolling state has been removed. It is to be appreciated that the controller 140 may confirm whether or not the paper rolling state has been removed even if the temperature measured by the temperature sensor 190 exceeds the reference temperature, but is within a tolerance range.

To confirm whether or not the paper rolling state has been removed, the controller 140 applies power to the heating lamp 93 of the fusing device 100 for a predetermined time (e.g., 15 seconds) and receives temperature information from the temperature sensor 190 installed to the fusing device 100.

Figure 5:
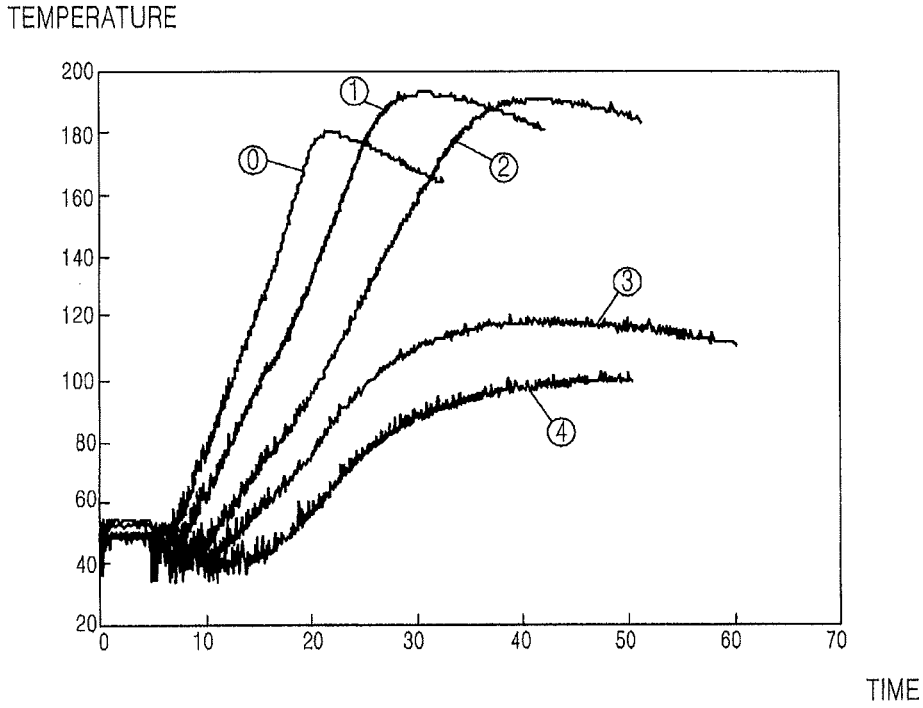
FIG. 5 is a graph illustrating temperature rising gradients depending on the number of sheets of rolled paper when power is applied for a predetermined time after paper rolling occurs in the fusing device of the image forming apparatus in accordance with the embodiment of the present invention.

The controller 140 judges that the paper rolling state has been removed if the temperature measured by the temperature sensor 190 is within a reference temperature range preset in the memory 150 after the predetermined time passes. If paper is rolled on the fusing device 100, the temperature measured by the temperature sensor 190 slowly rises and does not reach the reference temperature range. On the other hand, if the rolled paper has been removed from the fusing device 100, the temperature measured by the temperature sensor 190 rapidly rises and reaches the reference temperature range. Referring to FIG. 5, it is appreciated that temperature slowly rises in order of rolling no paper (⓪), rolling of one sheet of paper (①), rolling of two sheets of paper (②), rolling of three sheets of paper (③), and rolling of four sheets of paper (④).

Figure 6:
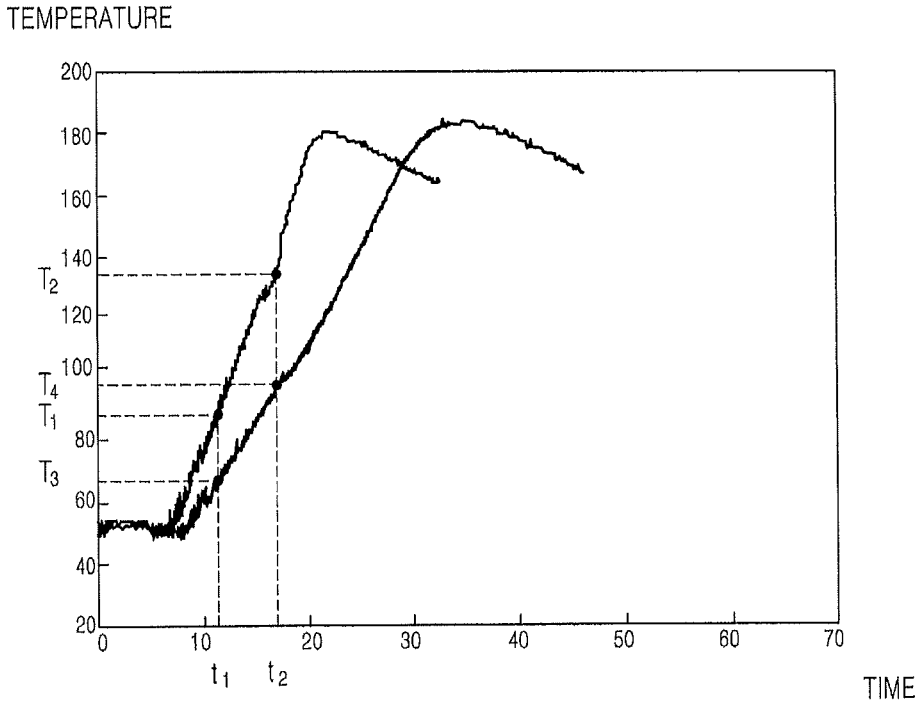
FIG. 6 is a graph comparing a temperature gradient when a paper rolling state has been removed with a temperature gradient in a paper rolling state in the fusing device of the image forming apparatus in accordance with the embodiment of the present invention.

While power is applied to the heating lamp 93 of the fusing device 100 to confirm whether or not the paper rolling state has been removed, the controller 140 detects a temperature rising gradient using the temperature transmitted from the temperature sensor 190 and compares the temperature rising gradient with a reference temperature rising gradient that is preset in the memory 150. Thereby, the controller 140 judges that the paper rolling state has been removed if the temperature rising gradient is within a tolerance range. Referring to FIG. 6, the temperature rising gradient m is $(T4-T3)/(t2-t1)$ if one sheet of paper is rolled on the fusing device 100, and the temperature rising gradient M is $(T2-T1)/(t2-t1)$ when the fusing device 100 has been released from the paper rolling state. Assuming that the temperature rising gradient preset in the memory 150 is M, the controller 140 judges that the fusing device 100 remains in the paper rolling state if $|M-m|>A$ (here, $|M-m|$ is a difference between the two temperature rising gradients M and m and A is the tolerance range). In this case, the controller 140 may calculate an average gradient by detecting the temperature of the fusing device 100 multiple times and compare the average gradient with the preset temperature rising gradient, so as to confirm whether or not the paper rolling state has been removed.

Figure 7:
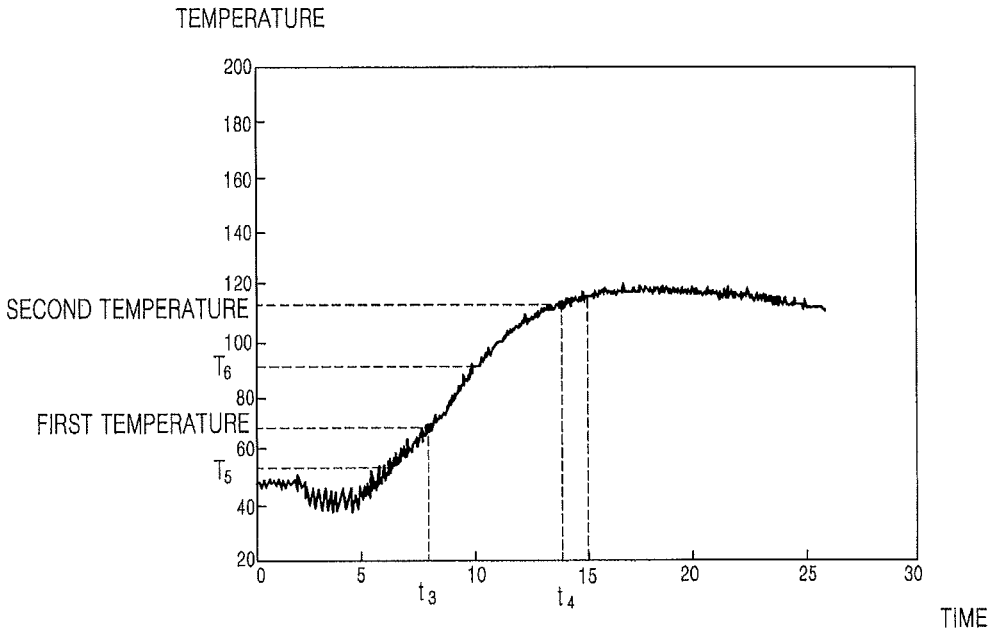
FIG. 7 is a graph comparing temperatures sampled multiple times while power is applied for a predetermined time after paper rolling occurs with respective reference temperatures in the fusing device of the image forming apparatus in accordance with the embodiment of the present invention.

Alternatively, while power is applied to the heating lamp 93 of the fusing device 100 to confirm whether or not the paper rolling state has been removed, the controller 140 may compare temperatures measured multiple times with a plurality of reference temperatures and may judge whether or not the paper rolling state has been removed based on comparative results. Now, an example in which the multiple times are twice will be described. Referring to FIG. 7, the controller 140 detects a first temperature transmitted from the temperature sensor 190 of the fusing device 100 at a time t3 after power is applied to the heating lamp 93 of the fusing device 100. If the first temperature is less than a first reference temperature T5, the controller 140 judges that the paper rolling state has not been removed. If the first temperature exceeds the first reference temperature T5, the controller 140 detects a second temperature transmitted from the temperature sensor 190 of the fusing device 100 at a time t4. The controller 140 may judge that the paper rolling state has not been removed if the second temperature is less than a second reference temperature T6, or may judge that the paper rolling state has been removed if the second temperature exceeds the second reference temperature T6. As described above, judging removal of the paper rolling state by comparing a plurality of measured temperatures with a plurality of reference temperatures may result in enhanced accuracy. Although removal of the paper rolling state is judged if the first temperature exceeds the first reference temperature and the second temperature exceeds the second reference temperature in the above described embodiment, this may be judged even if the first temperature is less than the first reference temperature, but is within a preset tolerance range and the second temperature is less than the second reference temperature, but is within a preset tolerance range. That is, judging removal of the paper rolling state by comparing a temperature measured at a predetermined time with a preset temperature of the memory 150 pertains to the embodiments.

In the case where the controller 140 applies power to the heating lamp 93 of the fusing device 100 for a predetermined time (e.g., 15 seconds) and receives temperature information from the temperature sensor 190 of the fusing device 100 in order to confirm removal of the paper rolling state as described above, the controller 140 may adjust the time for which power is applied to the heating lamp 93 of the fusing device 100.

To adjust the power application time with respect to the heating lamp 93 of the fusing device 100, the controller 140 may employ a transfer environment. The transfer environment may be determined based on a transfer resistance. Examples of the transfer environment include a high-temperature and high-humidity environment, a low-temperature and low-humidity environment, and a normal-temperature and normal-humidity environment. The transfer resistance means a resistance between the transfer roller 68 and the photoconductor 52. Referring to FIG. 8, the transfer environment corresponding to the magnitude of transfer resistance is preset in the memory 150. When confirming whether or not the paper rolling has been removed, the controller 140 may reduce the power application time with respect to the heating lamp 93 of the fusing device 100 under the high-temperature and high-humidity transfer environment, and may increase the power application time with respect to the heating lamp 93 of the fusing device 100 under the low-temperature and low-humidity transfer environment. For example, the controller 140 may confirm whether or not the measured temperature reaches the reference temperature after applying power for 20 seconds under the low-temperature and low-humidity transfer environment, and may confirm whether or not the measured temperature reaches the reference temperature after applying power for 15 seconds under the high-temperature and high-humidity transfer environment.

A look-up table representing the power application time with respect to the heating lamp 93 based on the transfer environments is preset in the memory 150. It is noted that a method of reducing errors due to peripheral environments is to reduce such heating time under the high-temperature and high-humidity transfer environment and increase the heating time under the low-temperature and low-humidity transfer environment.

The controller 140 may further employ temperature information of the fusing device 100 in order to adjust the power application time with respect to the heating lamp 93 of the fusing device 100. When the user turns the image forming apparatus 1 off and then on in a state in which information stored in the memory 150 says that the fusing device 100 remains in the paper rolling state, temperature information from the temperature sensor 190 of the fusing device 100 is transmitted to the controller 140. If the received temperature exceeds a predetermined temperature (e.g., 40° C.), this is an error state. If the received temperature is less than the predetermined temperature, the controller 140 adjusts the power application time with respect to the heating lamp 93. For example, when the user turns the image forming apparatus 1 off and then on, the controller 140 may increase the power application time with respect to the heating lamp 93 beyond a reference time if the temperature received from the temperature sensor 190 is 10° C. (here, the reference time may be determined based on the fusing device temperature of 25° C.)

and may reduce the power application time to below the reference time if the received temperature is 35° C.

The controller 140 may further employ both the transfer environment and temperature information of the fusing device 100 in order to adjust the power application time with respect to the heating lamp 93 of the fusing device 100. The controller 140 may adjust the power application time with respect to the heating lamp 93 of the fusing device 100 according to a look-up table in which both the transfer environment and the temperature information of the fusing device 100 are represented. The look-up table is a table in which power application times are sorted on the basis of transfer environments as a primary category and temperatures of the fusing device 100 at respective transfer environments as a secondary category.

When the user turns the image forming apparatus 1 off and then on in a state in which information stored in the memory 150 says that the fusing device 100 remains in the paper rolling state, the controller 140 confirms whether or not the fusing device 100 has been released from the paper rolling state. If it is confirmed that the paper rolling state has been removed, the controller 140 deletes information about the paper rolling state from the memory 150.

The transfer resistance detector 180 detects transfer resistance that represents the magnitude of resistance between the transfer roller 68, to which voltage is applied, and the photoconductor 52 when the transfer roller 68 and the photoconductor 52 define a nip therebetween. More particularly, if voltage is applied to the transfer roller 68 after the nip is defined between the transfer roller 68 and the photoconductor 52, the transfer resistance detector 180 detects current moving from the photoconductor 52 to a ground connected to the photoconductor 52. The transfer resistance detector 180 may detect the transfer resistance by performing calculation based on Ohm's law using the voltage applied to the transfer roller 68 and the detected current.

The memory 150 stores programs and various information of the image forming apparatus 1. The memory 150 further stores information about occurrence and removal of the paper rolling state of the fusing device 100. The memory 150 may be a non-volatile memory. Once information about the paper rolling state has been stored in the memory 150, the memory 150 does not volatilize the information in a state in which the fusing device 100 remains in the paper rolling state even if the image forming apparatus 1 is turned off. The information stored in the memory 150 may be deleted if the user pushes keys to enter removal of the paper rolling state or if the controller 140 judges removal of the paper rolling state and transmits the judged results to the memory 150.

Figure 9:
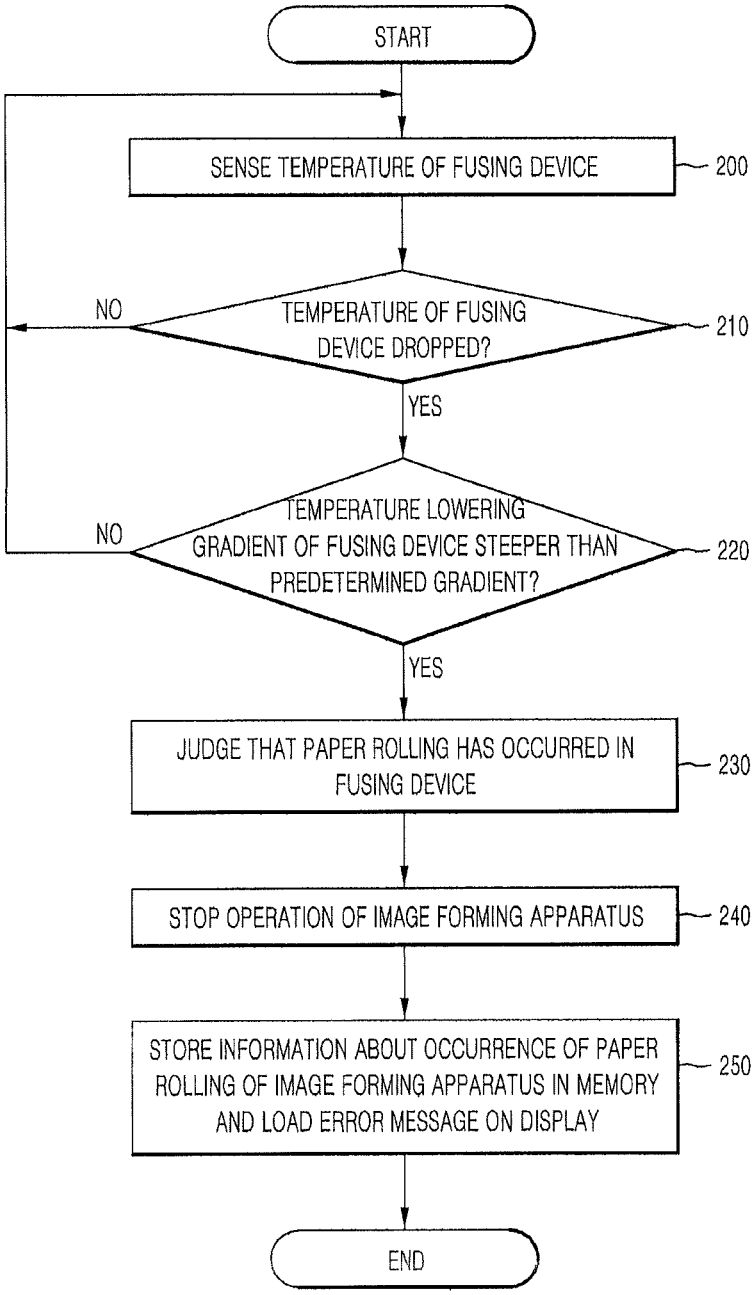
FIG. 9 is a control flowchart of a method of confirming whether or not paper rolling has occurred in the fusing device of the image forming apparatus in accordance with the embodiment of the present invention.

FIG. 9 is a control flowchart illustrating a method of detecting whether or not paper rolling has occurred in the fusing device 100 of the image forming apparatus 1 in accordance with the embodiment of the present invention.

The controller 140 receives temperature information in real time from the temperature sensor 190 installed to the fusing device 100 during operation of the image forming apparatus 1. The controller 140 detects whether or not temperature of the fusing device 100 drops (200 and 210).

If temperature drop of the fusing device 100 is detected, the controller 140 calculates a temperature lowering gradient and compares the calculated temperature lowering gradient with a reference gradient. If the temperature lowering gradient is steeper than the reference gradient, the controller 140 judges that paper rolling has occurred in the fusing device 100. If the paper rolling has occurred in the fusing device 100, this means that paper is present between the fusing roller 91 and the temperature sensor 190 used to measure temperature of the fusing device 100, which causes the temperature of the fusing device 100 to sharply drop as compared to the predetermined reference gradient. However, the controller 140 may judge that paper rolling does not occur if the temperature lowering gradient is not steeper than the reference gradient. Since the temperature of the fusing device 100 may drop due to other reasons, the reference gradient is determined only to confirm whether or not the paper rolling has occurred (220 and 230).

Once that paper rolling has occurred in the fusing device 100 is judged, the controller 140 stops the engine drive 160 and intercepts power applied by the high voltage power supply 170 so as to prevent overheating of the fusing device 100 (240).

Also, once that paper rolling has occurred on the fusing roller 91 is judged, the controller 140 loads an error message on the display (not shown) provided at the operating panel 130 and stores an error state due to paper rolling in the memory 150. The memory 150 is a non-volatile memory that does not lose information stored therein even if power is turned off (250).

Figure 10:
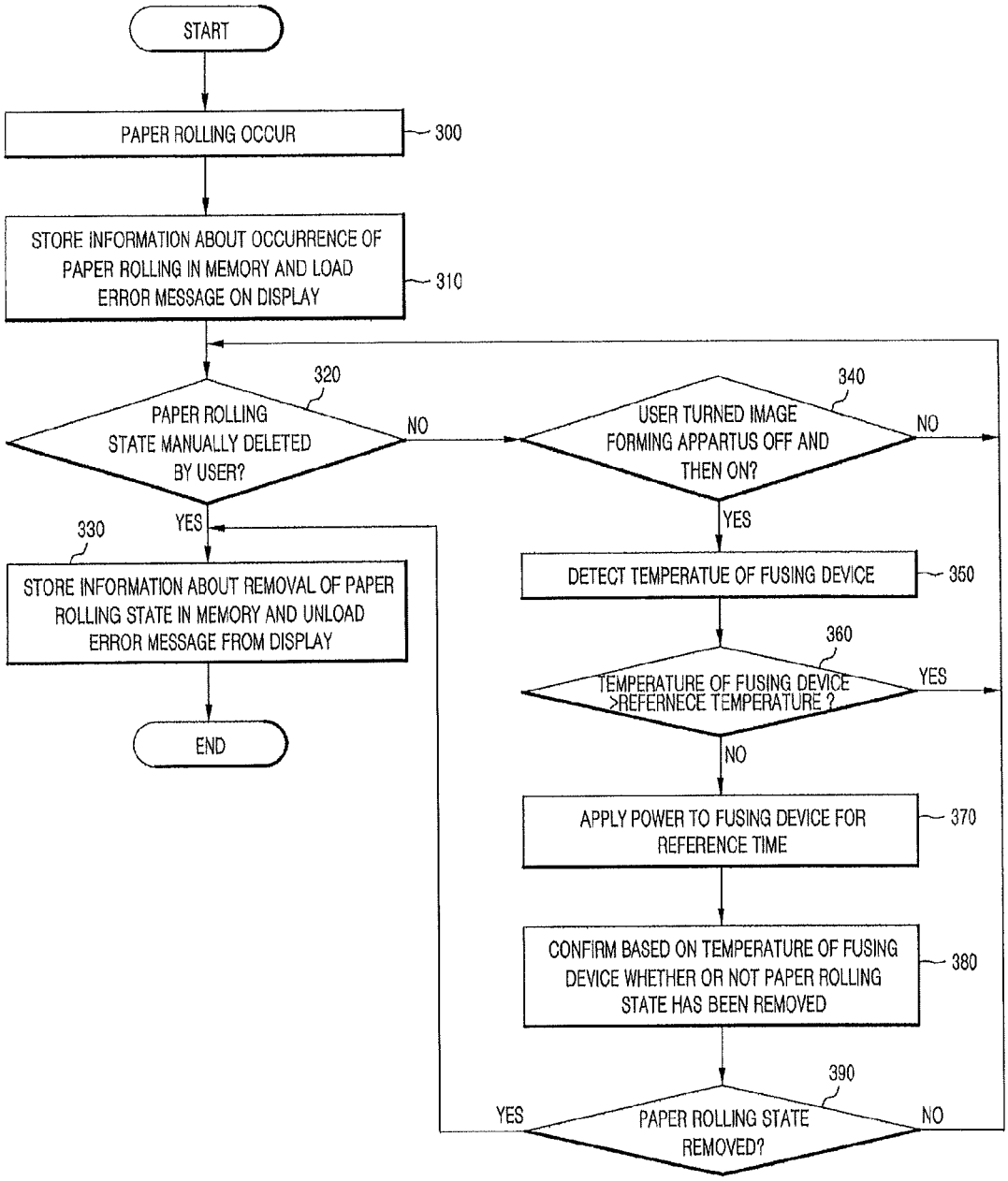
FIG. 10 is a control flowchart of a method of confirming whether or not the fusing device has been released from the paper rolling state.

FIG. 10 is a control flowchart illustrating a method of confirming whether or not the fusing device 100 has been released from the paper rolling state when the user turns the image forming apparatus 1 off and then on in a state in which information stored in the memory 150 says that the fusing device 100 remains in the paper rolling state.

As described above with reference to FIG. 9, once that paper rolling has occurred is judged, the controller 140 stores occurrence of the paper rolling in the memory 150 and loads an error message on the display of the operating panel 130 (300 and 310).

If the user performs a predefined key input operation using the operating panel 130 or inputs an error release command using the host 110 after removing the rolled paper from the fusing device 100, the controller 140 deletes information about the error state due to the paper rolling from the memory 150 and unloads the error message from the display (330).

The controller 140 confirms whether the user turns the image forming apparatus 1 off and then on in a state in which the error state due to the paper rolling is not deleted. If the user turns the image forming apparatus 1 off and then on, the controller 140 detects the temperature of the fusing device 100 (340 and 350).

The controller 140 maintains the error state of the image forming apparatus 1 if the temperature of the fusing device 100 exceeds a reference temperature (e.g., 40° C.). Maintaining the error state means that the error state is continuously stored in the memory 150 and the display of the operating panel 130 continuously loads the error state (360).

If the temperature of the fusing device 100 is less than the reference temperature, the controller 140 applies power to the heating lamp 93 of the fusing device 100 for a predetermined time. Here, the power application time with respect to the fusing device 100 may be changed according to the transfer environment and initial temperature of the fusing device 100. The memory 150 stores a look-up table in which power application times are sorted based on the transfer environment and initial temperature of the fusing device 100. It is appreciated that the controller 140 may determine the power application time using any one of the transfer environment and the initial temperature of the fusing device 100. Although FIG. 10 illustrates that the power is applied if the temperature of the fusing device 100 is less than the reference temperature, the controller 140 may be designed to apply power even if the temperature of the fusing device 100 exceeds the reference temperature, but is within a tolerance range (370).

The controller 140 confirms, based on the temperature of the fusing device 100, whether or not the paper rolling state has been removed. The controller 140 applies power to the fusing device 100 for a predetermined time so as to heat the fusing device 100 and then, measures the temperature of the fusing device 100. If the measured temperature exceeds a predetermined temperature, or if the temperature is less than the predetermined temperature, but is within a tolerance range, the controller 140 judges that the fusing device 100 has been released from the paper rolling state (380).

Once that the fusing device 100 has been released from the paper rolling state is judged, the controller 140 deletes information about the error state due to the paper rolling state from the memory 150 and unloads the error message from the display (390 and 330).

As is apparent from the above description, in accordance with one aspect of the invention, whether or not paper rolling has occurred in a fusing device may be simply confirmed using only temperature variation of the fusing device.

In accordance with another aspect of the invention, whether or not the fusing device has release from the paper rolling may be simply confirmed using only temperature variation of the fusing device.

Although the embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a fusing device;

a temperature sensor to sense a temperature of the fusing device;

a memory in which information about occurrence and removal of a paper rolling state in the fusing device is stored; and a controller, which detects an initial temperature of the fusing device when the image forming apparatus is turned on in a state in which information about occurrence of the paper rolling state is stored in the memory, which heats the fusing device by applying power to the fusing device for a predetermined time, and which judges whether or not the paper rolling state has been removed based on the temperature of the fusing device.

2. The apparatus according to claim 1, wherein the memory is a non-volatile memory and maintains the information about occurrence of the paper rolling state stored therein even if the image forming apparatus is turned off.

3. The apparatus according to claim 1, wherein the judging whether or not the paper rolling state has been removed based on the temperature of the fusing device includes judging that the paper rolling state has been removed if the temperature of the fusing device detected after power is applied to the fusing device for the predetermined time exceeds a predetermined reference temperature.

4. The apparatus according to claim 3, wherein the judging whether or not the paper rolling state has been removed based on the temperature of the fusing device includes judging that the paper rolling state has not been removed if the temperature of the fusing device detected after power is applied to the fusing device for the predetermined time is less than the predetermined reference temperature.

5. The apparatus according to claim 1, wherein the judging whether or not the paper rolling state has been removed based on the temperature of the fusing device includes:

detecting the temperature of the fusing device multiple times while power is applied to the fusing device for the predetermined time; and judging whether or not the paper rolling state has been removed by comparing the multiple detected temperatures of the fusing device with different reference temperatures ordered by time.

6. The apparatus according to claim 5, wherein the judging whether or not the paper rolling state has been removed by comparing the multiple detected temperatures of the fusing device with different reference temperatures includes:

comparing the detected temperatures of the fusing device with the respective corresponding reference temperatures ordered by detection time; and judging that the paper rolling state has been removed if all the detected temperatures of the fusing device exceed the respective corresponding reference temperatures.

7. The apparatus according to claim 5, wherein the judging whether or not the paper rolling state has been removed by comparing the multiple detected temperatures of the fusing device with different reference temperatures includes:

comparing an average gradient of the multiple detected temperatures of the fusing device with an average gradient of the different reference temperatures; and judging that the paper rolling state has been removed if the average gradient of the temperatures of the fusing device exceeds the average gradient of the different reference temperatures.

8. The apparatus according to claim 1, further comprising a transfer resistance detector to detect a transfer resistance between a transfer roller and a photoconductor included in the image forming apparatus, wherein the memory stores information about a transfer environment corresponding to the transfer resistance.

9. The apparatus according to claim 8, wherein the memory stores a look-up table which represents a power application time with respect to the fusing device to judge whether or not the paper rolling state has been removed, wherein the power application time corresponds to at least one of the transfer environment information based on the transfer resistance and the initial temperature of the fusing device.

10. A control method of an image forming apparatus, the method comprising:

storing information about occurrence of a paper rolling state of a fusing device;

detecting an initial temperature of the fusing device if the image forming apparatus is turned on in a state in which the information about occurrence of the paper rolling state is stored in a memory;

heating the fusing device by applying power to the fusing device for a predetermined time; and judging whether or not the paper rolling state has been removed based on the temperature of the fusing device detected after the power is applied.

11. The method according to claim 10, wherein in the heating the fusing device by applying power to the fusing device for the predetermined time, the predetermined time is determined based on at least one of the initial temperature of the fusing device and a transfer environment of the image forming apparatus.

12. The method according to claim 10, wherein the judging whether or not the paper rolling state has been removed includes judging that the paper rolling state has been removed if the temperature of the fusing device detected after power is applied for the predetermined time exceeds a preset reference temperature.

13. The method according to claim 10, wherein the judging whether or not the paper rolling state has been removed includes judging that the paper rolling state has not been removed if the temperature of the fusing device detected after power is applied for the predetermined time is less than a preset reference temperature.

14. The method according to claim 10, wherein the judging whether or not the paper rolling state has been removed includes:

detecting the temperature of the fusing device multiple times;

comparing the multiple detected temperatures of the fusing device with different reference temperatures; and judging that the paper rolling state has been removed if all the multiple detected temperatures of the fusing device exceed the respective reference temperatures.

15. The method according to claim 10, wherein the judging whether or not the paper rolling state has been removed includes:

detecting the temperature of the fusing device multiple times;

comparing the multiple detected temperatures of the fusing device with different reference temperatures; and judging that the paper rolling state has not been removed if at least one of the multiple detected temperatures of the fusing device is less than the corresponding reference temperature.

16. The method according to claim 10, wherein the judging whether or not the paper rolling state has been removed includes:

detecting the temperature of the fusing device multiple times to calculate an average gradient of the temperatures; and judging that the paper rolling state has been removed if the average gradient exceeds a predetermined reference gradient.

17. The method according to claim 10, wherein the judging whether or not the paper rolling state has been removed includes:

detecting the temperature of the fusing device multiple times to calculate an average gradient of the temperatures; and judging that the paper rolling state has not been removed if the average gradient is less than a predetermined reference gradient.

18. A control method of an image forming apparatus, the method comprising:

storing information about occurrence of a paper rolling state of a fusing device;

detecting an initial temperature of the fusing device if the image forming apparatus is turned on in a state in which the information about occurrence of the paper rolling state is stored in a memory;

heating the fusing device by applying power to the fusing device for a predetermined time;

judging whether or not the paper rolling state has been removed based on the temperature of the fusing device detected after the power is applied; and adjusting a power application time of a heating lamp of the fusing device.

19. The method according to claim 18, wherein adjusting the power application time comprises:

determining if a transfer environment comprises a high-temperature and high-humidity transfer environment or a low-temperature and low humidity transfer environment;

reducing the power application time with respect to the heating lamp of the fusing device, if the transfer environment comprises the high-temperature and high-humidity transfer environment;

increasing the power application time with respect to the heating lamp of the fusing device, if the transfer environment comprises the low-temperature and low-humidity transfer environment.

* * * * *